US012538948B2

(12) United States Patent
Long et al.

(10) Patent No.: US 12,538,948 B2
(45) Date of Patent: Feb. 3, 2026

(54) CATCHER'S LEG GUARD

(71) Applicant: Wilson Hunt International, Ltd., Wheeling, IL (US)

(72) Inventors: Keenan Long, Norridge, IL (US); Matthew Klein, Wheeling, IL (US)

(73) Assignee: Wilson Hunt International, Ltd., Wheeling, IL (US)

( * ) Notice: Subject to any disclaimer, the term of this patent is extended or adjusted under 35 U.S.C. 154(b) by 157 days.

(21) Appl. No.: 17/890,144

(22) Filed: Aug. 17, 2022

(65) Prior Publication Data

US 2023/0053749 A1 Feb. 23, 2023

Related U.S. Application Data

(60) Provisional application No. 63/233,918, filed on Aug. 17, 2021.

(51) Int. Cl.

| | |
|---|---|
| ***A41D 13/05*** | (2006.01) |
| ***A41D 13/06*** | (2006.01) |
| ***A63B 71/12*** | (2006.01) |

(52) U.S. Cl.

CPC ..... *A41D 13/0543* (2013.01); *A41D 13/065* (2013.01); *A63B 71/1225* (2013.01);

(Continued)

(58) Field of Classification Search

CPC ..... A41D 13/0543; A41D 13/065; A41D 13/0568; A41D 13/0153; A41D 13/015; A41D 13/05; A41D 13/08; A41D 13/00; A41D 13/0156; A41D 13/02; A41D 13/0158; A41D 13/0518; A41D 13/0556; A41D 13/01; A41D 13/0562; A41D 13/0155; A41D 13/0512; A41D 13/0575; A41D 13/0581; A41D 13/0593; A41D 13/0015; A41D 13/012; A41D 13/06; A41D 13/0002; A41D 13/0012; A41D 13/005; A41D 13/018; A41D 13/04; A41D 13/0506; A41D 13/0537; A41D 13/0587; A41D 13/1176; A41D 31/28; A41D 31/08;

(Continued)

(56) References Cited

U.S. PATENT DOCUMENTS 3,735,419 A * 5/1973 Byrd ..... A63B 71/1225 2/22
4,692,946 A 9/1987 Jurga (Continued)

FOREIGN PATENT DOCUMENTS

CA 2180919 A1 * 1/1998 ..... A63B 71/1225
FR 2600900 A1 * 1/1988 ..... A63B 71/1225

(Continued)

*Primary Examiner* — Grace Huang
(74) *Attorney, Agent, or Firm* — Boyle Fredrickson, S.C.

(57) ABSTRACT

According to the present disclosure, a leg guard is provided with a splint connector that connects a knee guard with a thigh guard. The splint is made of a material and shaped in a way that allows the connector to hold tension like a rope, to hold compression like a support beam, to bend in one plane like a single hinge through the full range of the knee joint, to twist slightly and to create and maintain a consistent separation distance between the knee guard and the thigh guard while the leg guard including the connector is being worn.

13 Claims, 4 Drawing Sheets

(52) U.S. Cl.
CPC . *A63B 2071/1241* (2013.01); *A63B 2071/125* (2013.01); *A63B 2071/1258* (2013.01); *A63B 2071/1275* (2013.01)

(58) Field of Classification Search
CPC ..... A41D 31/04; A41D 31/12; A41D 31/245; A41D 31/85; A41D 31/0005; A41D 31/065; A41D 31/10; A41D 31/18; A41D 31/24; A41D 31/30; A41D 31/325; A41D 31/285; A41D 31/02; A41D 31/14; A41D 2600/00; A41D 2600/20; A41D 2300/322; A41D 2300/22; A41D 2300/32; A41D 2300/328; A41D 2300/33; A41D 1/06; A41D 1/067; A41D 1/08; A41D 1/088; A41D 11/00; A41D 19/01523; A41D 2400/14; A41D 2400/10; A41D 2400/32; A41D 2500/50; A41D 2600/102; A41D 27/02; A41D 27/12; A41D 27/16; A41D 27/08; A41D 27/10; A41D 27/20; A41D 27/201; A41D 27/22; A41D 27/24; A41D 27/245; A41D 27/285; A41D 17/02; A41D 19/0048; A41D 2200/20; A41D 3/00; A63B 71/1225; A63B 2071/125; A63B 2071/1233; A63B 2071/1283; A63B 2071/1258; A63B 2071/1266; A63B 2071/1275; A63B 2071/0063; A63B 2071/027; A63B 2071/00043; A63B 2071/028; A63B 2071/04; A63B 2071/0555; A63B 2071/154; A63B 2071/4013; A63B 2071/4015; A63B 2071/4033; A63B 2071/4034; A63B 2071/4049; A63B 71/10; A63B 71/1216; A63B 71/1291; A63B 71/141; A63B 71/145; A63B 71/12; A63B 71/081; A63B 71/08; A63B 71/06; A63B 71/085; A63B 71/1241; A63B 71/1208; A63B 71/14; A63B 71/0054; A63B 71/1266; A63B 71/04; A63B 71/00; A63B 71/0622; A63B 71/143; A63B 71/148; A63B 21/0724; A63B 21/072; A63B 21/0726; A63B 21/0557; A63B 21/0442; A63B 21/0004; A63B 21/00047; A63B 21/00065; A63B 21/00069; A63B 21/0435; A63B 21/0552; A63B 21/4023; A63B 21/4029; A63B 21/4035; A63B 21/00185; A63B 21/023; A63B 21/0407; A63B 21/045; A63B 21/055; A63B 21/153; A63B 21/4025; A63B 21/4005; A63B 21/4007; A63B 21/4009; A63B 21/4011; A63B 2243/0025; A63B 2243/007; A63B 2243/0095; A63B 2220/13; A63B 2220/16; A63B 2220/20; A63B 2220/24; A63B 2220/30; A63B 2220/40; A63B 2220/51; A63B 2220/53; A63B 2220/56; A63B 2220/72; A63B 2220/74; A63B 2220/75; A63B 2220/76; A63B 2220/803; A63B 2220/806; A63B 2220/807; A63B 2220/833; A63B 2220/836; A63B 2225/30; A63B 2225/50; A63B 2225/54; A63B 2225/74; A63B 2230/06; A63B 2230/60; A63B 2230/70; A63B 2230/04; A63B 2230/50; A63B 2243/0037; A63B 2243/0054; A63B 2243/0066; A63B 2244/102; A63B 2244/18; A63B 2244/19; A63B 2244/20; A63B 2244/203; A63B 43/004; A63B 43/005; A63B 60/46; A63B 60/16; A63B 69/002; A63B 69/0026; A63B 69/0028; A63B 69/0048; A63B 69/0071; A63B 69/02; A63B 69/06; A63B 69/16; A63B 69/3632; A63B 69/38; A63B 69/36; A63B 69/0062; A63B 2208/0204; A63B 2208/12; A63B 24/0006; A63B 24/0021; A63B 24/0062; A63B 24/0075; A63B 2209/10; A63B 2209/00; A63B 22/203; A63B 22/20; A63B 23/0211; A63B 23/1218; A63B 23/1227; A63B 23/1236; A63B 23/1245; A63B 23/1254; A63B 23/1263; A63B 23/1272; A63B 23/1281; A63B 23/129; A63B 23/14; A63B 23/0205; A63B 23/0233; A63B 23/0244; A63B 23/0494; A63B 23/085; A63B 23/10; A63B 2102/24; A63B 2102/14; A63B 2102/182; A63B 2102/18; A63B 2102/22; A63B 2208/0219; A63B 2208/0214; A63B 2208/0257; A63B 2209/02; A63B 2209/14; A63B 2225/09; A63B 67/00; A63B 2225/62; A63B 2023/006; A63B 25/10; A63B 63/004
USPC ..... 2/22
See application file for complete search history.

(56) References Cited

U.S. PATENT DOCUMENTS

| | | | | | |
|---|---|---|---|---|---|
| 5,107,823 | A * | 4/1992 | Fratesi | A41D 13/0568 | 2/22 |
| 5,662,594 | A * | 9/1997 | Rosenblatt | A61F 5/013 | 2/2.5 |
| 6,128,779 | A * | 10/2000 | Goldsmith | A63B 71/1225 | 2/22 |
| 6,178,556 | B1 * | 1/2001 | Foreman | A63B 71/08 | 2/22 |
| 6,317,888 | B1 * | 11/2001 | McFarlane | A41D 13/065 | 2/24 |
| 6,789,264 | B2 * | 9/2004 | Budda | A63B 71/1225 | 2/22 |
| 6,912,729 | B2 * | 7/2005 | Nishimoto | A63B 71/1225 | 2/22 |
| 7,188,370 | B2 * | 3/2007 | Bevier | A63B 71/1225 | 2/22 |
| 7,832,017 | B2 * | 11/2010 | Nascimento | A63B 71/1225 | 2/22 |
| 7,841,019 | B2 * | 11/2010 | Godshaw | A41D 13/00 | 2/24 |
| 8,510,862 | B1 * | 8/2013 | Contant | A63B 71/1225 | 2/22 |
| 9,149,709 | B1 * | 10/2015 | Schuster | A41D 13/0543 | |
| 10,293,241 | B2 | 5/2019 | Rodrick et al. | | |
| 11,058,939 | B2 | 7/2021 | Rodrick et al. | | |
| 11,202,954 | B2 * | 12/2021 | Runzo | A63B 71/1225 | |
| 2006/0096000 | A1 * | 5/2006 | Romero | A41D 13/0568 | 2/22 |
| 2007/0250977 | A1 * | 11/2007 | Brown | A41D 13/0543 | 2/22 |
| 2013/0007938 | A1 * | 1/2013 | LoCicero | A41D 13/06 | 2/24 |
| 2015/0033433 | A1 * | 2/2015 | Mackey | A63B 71/1225 | 2/22 |

FOREIGN PATENT DOCUMENTS

| | | | | |
|---|---|---|---|---|
| GB | 745558 A * | 2/1956 | | A41D 13/065 |
| KR | 100723039 B1 * | 5/2007 | | A63B 71/1225 |

* cited by examiner

CATCHER'S LEG GUARD

CROSS-REFERENCE TO RELATED APPLICATIONS

The present application claims priority from U.S. Provisional Patent Application Ser. No. 63/233,918, filed on Aug. 17, 2021, the entirety of which is expressly incorporated by reference herein for all purposes.

FIELD OF THE DISCLOSURE

The present invention relates to sports equipment, and in particular to a leg guard for a baseball or softball catcher.

BACKGROUND OF THE DISCLOSURE

Baseball and softball catchers are positioned behind home plate and perform many important functions during a game, from calling plays and protecting the plate to catching the ball thrown by the pitcher. Due to impacts from pitches, sometimes in excess of 90 mph, and home plate crashes with other players, the bodies of catchers are regularly exposed to physical trauma.

One particular physical injury that catchers are especially prone to is knee injuries. Due to the crouching position catchers assume behind home plate, catchers commonly injure their knees. For instance, the crouching position exposes the inner legs of a catcher to impacts from pitches. Because of this exposure, the inner side portions of a catcher's knees are often struck by the ball. Collisions at home plate from opposing team players trying to score also often result in slides that impact or injure the catcher's lower legs and knees. These types of injuries can seriously hinder the catcher's ability to perform vital functions during the game.

Current leg guards exist that provide some protection to the knee, thigh, and shin areas. Existing leg guards typically include a triple kneecap design, where three separate protective paddings come together to cover and protect the knee. For example, U.S. Pat. No. 4,692,946 to Jurga describes a triple kneecap design where a pair of flexible straps is utilized to secure the knee guard, first thigh guard, and second thigh guard to each other. The leg guards usually include additional protective padding to protect the thigh and shin portions of the leg. However, existing triple kneecap designs do not provide sufficient protection for the inner side portions of a catcher's knees.

In addition, catcher's leg guards are attached around the legs utilizing elastic connecting straps that rely on squeezing the leg guards against the wearer's leg to keep the leg guard in place. Because there is nothing outside of the friction between the straps/leg guards and the leg/uniform of the wearer to counteract the vertically downward force of gravity, it is common for leg guards to sag in use especially when the user goes from the crouched position to the standing position and back. For example, a catcher's blocking motions for stopping wild pitches requires that the catcher drop quickly onto their knees from the crouching position and just as quickly either reassume the crouching position or stand upright to throw out any potential base stealers. In doing so, the pads of the catcher's leg guard often become misaligned and mispositioned. When a catcher assumes the crouching position, the leg guard slides down the leg of the catcher about 3 inches. However, when the catcher reassumes a standing upright position from the crouching position, the leg guard does not slide back up into place to protect the thigh. Not only can this be distracting to the catcher, but it also requires the wearer to constantly pull up on the leg guards to reposition and align them on the leg of the wearer.

Further, to try and accommodate this shifting of the leg guard due to the movement of the wearer, current leg guards connect the knee plate and the thigh plate with connectors, such as flexible elastic straps or braided straps, that can only hold the knee plate and thigh plate in the proper position when under tension, i.e., the straps are pulled on from one or both ends. When compression is applied by the weight of the thigh plate on top of the knee plate, i.e., the straps are pressed on from one or both ends, the flexible nature of the straps is not able to apply any force to keep the knee plate and thigh plate separated. This results in the thigh plate and knee plate coming closer together and ultimately leads to the unwanted sagging of the leg guards and resulting in the entire leg guard not fitting properly.

To attempt to accommodate this issue, U.S. Pat. Nos. 10,293,241 and 11,058,939 to Rodrick et al., each of which are expressly incorporated herein by reference in their entirety for all purposes, disclose a leg guard for a catcher in which the portion of the leg guard covering the thigh and the portion of the leg guard covering the knee are interconnected by a pair of hinge arms integrally formed with the thigh portion. The hinge arms are rotatably connected to the knee portion to rotate with regard to the knee portion when the catcher bends his or her knee. The hinge arms are formed of the same material as the cover plate of the thigh portion and thus do not stretch, bend or flex, thereby maintaining the position of the knee portion relative to the thigh portion during use of the leg guard.

However, while able to maintain the position of the portions of the leg guard over the knee of the wearer during use, the rigid nature of the hinge arms significantly reduces the flexibility of the leg guard with regard to any non-linear movement of the leg of the catcher, e.g. and twisting or lateral movement. This can impair the movement of the wearer and thus there still remains a need for a leg guard that more adequately protects the catcher's knees and allows catchers to freely and quickly move to or through different stances without having to re-position the pads of the leg guard.

SUMMARY OF THE DISCLOSURE

According to one exemplary embodiment of the present disclosure, a leg guard is provided with a spined splint that connects the knee plate with the thigh plate. The splint is made of a material and shaped in a way that allows the splint to hold tension like a rope, to hold compression like a support beam, to bend in one plane like a single hinge through the full range of the knee joint, and to twist slightly and to create and maintain a consistent separation distance between the knee plate and the thigh plate while the leg guard including the splint is being worn.

According to another exemplary embodiment of the disclosure, a leg guard includes a first guard, a second guard, and a connector secured between the first guard and the second guard, wherein the connector is formed of a material that is flexible but resistant to stretching and compression forces.

Other objectives, features, benefits and advantages of the present invention will be apparent from this summary and its descriptions of certain embodiments of such formulations and compositions, and will be readily apparent to those skilled in the art having knowledge of the synthetic techniques described therewith. Such objectives, features, benefits and advantages will be apparent from the above as taken into conjunction with the accompanying examples, data, and all reasonable inferences to be drawn therefrom.

BRIEF DESCRIPTION OF THE DRAWINGS

The drawings illustrate the best mode currently contemplated of practicing the present invention.

In the Drawings.

DETAILED DESCRIPTION OF THE DISCLOSURE

Figure 1:
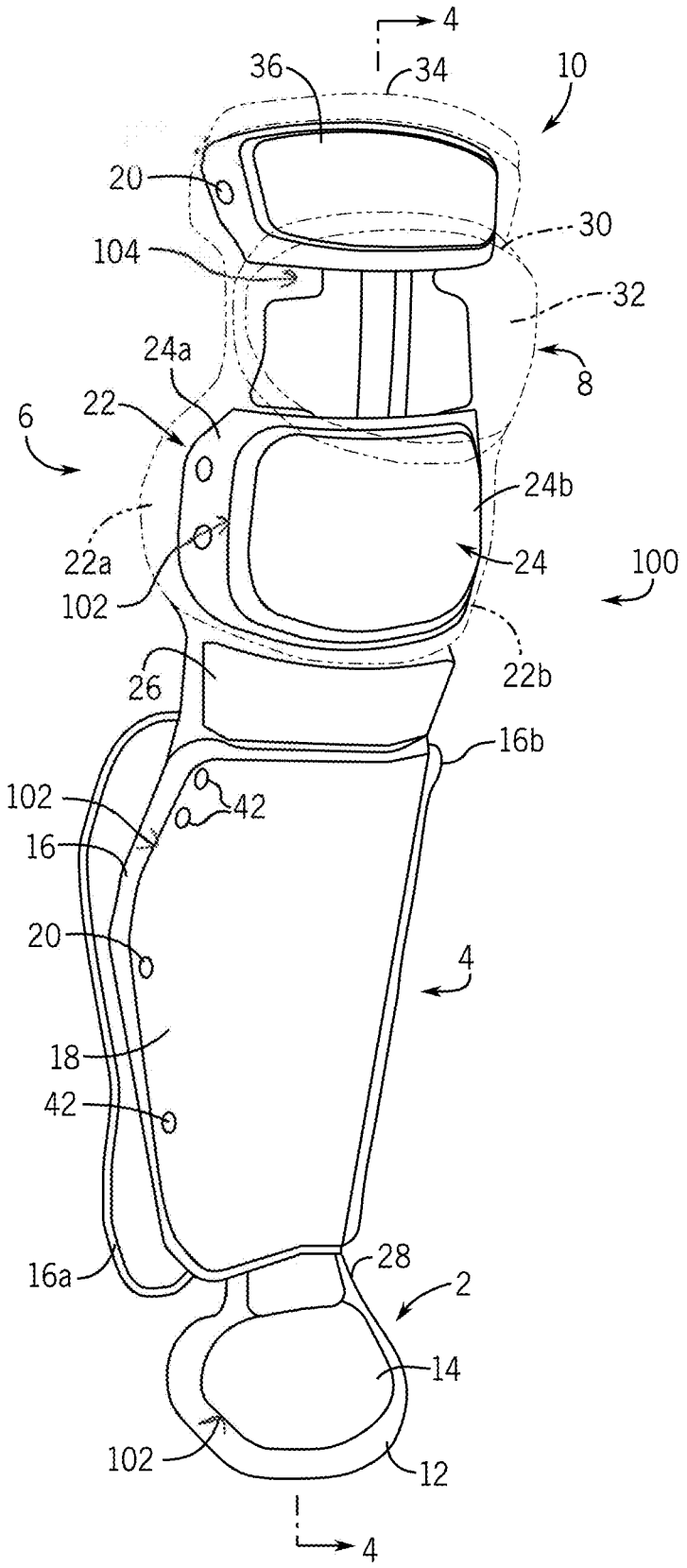
FIG. 1 is an isometric view of a leg guard constructed according to the present disclosure.

Referring to FIG. 1, a leg guard in accordance with the present invention is shown generally at 100. The leg guard 100 includes a toe guard 2, a shin guard 4, a knee guard 6, an extended knee guard 8, a thigh guard 10, and a knee-protecting pad extension 26. The leg guard 100 also includes a plurality of loops 42 to which one or more straps (not shown) may be fastened in order to secure the leg guard 100 around the leg of an individual, with one or more straps extending between opposed sides of the shin guard 4 around the lower leg (shin and calf) of the individual below the knee, and one more straps extending between opposed sides of the thigh guard 10 around the upper leg (thigh) of the individual above the knee to hold the leg guard 100 on the leg of the individual. The leg guard 100 of the present disclosure is suitable for both adults and youths. As will be apparent to one of ordinary skill in the art, the design and dimensions of a youth version of the leg guard 100 according to the present invention is proportional to an adult version of the leg guard according to the present disclosure.

The toe guard 2 includes a cushion pad 12 formed of a suitable cushioning material, such as a foam material, a cloth material, an inflatable or air-filled material, a rubber material, or any combination thereof. The toe guard 2 also includes a cover plate 14 that covers the cushion pad 12 and is affixed thereto. The cover plate 14 can be formed of any suitable rigid and/or impact resistant material, such as a hard plastic. While FIG. 1 shows the cushion pad 12 extending beyond the periphery of the cover plate 14 to prevent the periphery of the cover plate 14 from directly contacting the leg of the individual, any other configuration and/or shape of the cushion pad 12 and cover plate 14 is also considered to be within the scope of the present disclosure. Further, while the exemplary illustrated embodiment shows stitching 102 connecting the cover plate 14 to the cushion pad 12, the affixation of the cover or plate 14 to the cushion pad 12 may be accomplished in any manner that results in a semi-permanent or permanent attachment between the cover plate 14 and the cushion pad 12. For example, the cover plate 14 may be affixed atop the cushion pad 12 by a securing mechanism formed of rivets, fasteners, stitching, adhesive(s), or a combination thereof.

In one embodiment, the toe guard 2 is shaped to cover and fit around the top portion of the user's foot. The toe guard 2 may be shaped and/or contoured to follow the contour typical of the top portion of the foot of a user. In another embodiment, toe guard 2 may be flexible or articulated such that the toe guard does not remain in a fixed position. In either of these embodiments or any other embodiment, the cushion pad 12 can be formed to be flexible with regard to the shape of the foot of the user, and the cover shell or plate 14 can be formed to be either rigid or slightly flexible with regard to the shape or contour of the foot of the user.

In order to accommodate the extreme angle of the ankle joint while the user is in a crouching or upright position, the toe guard 2 is connected to the shin guard 4 via an ankle extension 28. In one embodiment, the ankle extension 28 is a separate component with one end connected to the shin guard 4 and the other end to toe guard 2. More specifically, the ankle extension 28 may be disposed between the cover plate 14 and the cushion pad 12 of the toe guard 2 and between the cover plate 18 and cushion pad 16 of the shin guard 4. In another exemplary embodiment, the extension 28 can be formed at least partially integrally with and can extend between the cushion pad 12 and the cushion pad 16. The extension 28 can be formed of the same material as the cushion pad 12 and/or can include a semi-flexible cover or insert (not shown) to provide an additional amount of impact protection for the area of the ankle covered by the extension 28.

The shin guard 4 in FIG. 1 includes a cushion pad 16 and a cover plate 18 that covers the cushion pad 16 and is affixed thereto. The affixation of the cover plate 18 to the cushion pad 16 may occur in any manner that results in a semi-permanent or permanent attachment between the cover plate 18 and the cushion pad 16, which can be the same as, or similar to the manner of securing the cover plate 14 to the cushion pad 12. For example, the cover plate 18 may be affixed atop the cushion pad 16 with rivets, fasteners, stitching, or a combination thereof. In addition, the affixation of the cover shell 18 to the cushion pad 16 may be discontinuous or continuous. The cushion pad 16 and cover plate 18 are both contoured to follow the contour typical of the shin portion of the leg of a user. This contouring provides for a more comfortable fit. The material forming the cushion plate 16 can be a foam, a cloth, or an air-pocket including and/or inflatable material, or any combination thereof. The material forming the cushion pad 16 can also be capable of absorbing and retaining moisture, such as sweat, to provide a cooling function to the cushion pad 16.

In one embodiment, cushion pad 16 may include flexible winged side panels 16*a*, 16*b* for additional comfort and/or protection for the side of the user's leg. The side panels 16*a*, 16*b* extend outwardly from each side of the cushion panel 16 and can be formed of a material similar to that of the cushion panel 16, and/or the ankle extension 28. The side panels 16*a*, 16*b* provide an additional amount of impact protection outside of the perimeter of the cover plate 18 and can additionally limit the potential for any direct contact of the perimeter of the cover plate 18 with the user. The side panels 16*a*, 16*b* can be formed integrally with the cushion pad 16, or can be formed to be removably secured to the sides of the cushion plate 16.

The cover plate 18 is formed of a rigid and impact resistant material, such as a material similar to that used in forming the cover plate 14, including a hard plastic material, and may include a plurality of air vents 20 that extend through the cover plate 18 to allow for ventilation and expelling of sweat accumulated on and/or within the cushion pad 16 through the direct or indirect contact of the cushion pad 16 with the leg of the user. The positioning and quantity of air vents 20 are not limited. For instance, the cover plate 18 may include a plurality of air vents 20 along the median of the plate 18, the lateral sides of the plate 18, or any combinations thereof, e.g., a plurality of air vents 20 may be positioned along the left and right sides of the cover plate 18 as well as along the median.

The knee guard 6 includes a cushion pad 22 and a cover plate 24 that covers the cushion pad 22 and is affixed thereto. The cushion pad 22 is formed similarly to cushion pad 12 and or 16, can additionally formed of a moisture absorbing material. In one embodiment, similar to the cushion pad 16, the cushion pad 22 may include flexible side panels 22*a*, 22*b* for additional protection for the sides of the user's knee. The cushion pad 22 is formed similarly to the cushion pads 12, 16 to provide the desired cushioning and moisture wicking functions, and the side panels 22*a*, 22 are formed similarly to the side panels 16*a*, 16*b*. Cover plate 24 is formed similarly to the cover plate 14, 18 in order to provide the desired impact protection function.

In one embodiment of the present invention, the upper edge of the shin guard 4 and a lower edge of the knee guard 6 is spanned or connected by a knee-protecting pad extension 26. The knee-protecting pad extension 26 provides a layer of padding that covers a lower portion of the cushion pad 22 of the knee guard 6. In one exemplary embodiment, the pad extension 26 is formed similarly to the extension 28, such as at least partially integrally with and extending between the cushion pad 16 and the cushion pad 22. The extension 26 can be formed of the same material as the cushion pads 16 and 22 and/or can include a semi-flexible cover or insert (not shown) to provide an additional amount of impact protection for the area of the knee covered by the extension 26.

According to the present invention, the cover plate 24 of knee guard 6 covers not only the kneecap portion of the leg, but also extends laterally to cover a significant portion of the lateral sides of the knee. That is, the cover plate 24 is shaped as a round, extended bowl so that the cover plate 24 and cushion pad 22 affixed thereto wraps around the knee and protects both the kneecap and the lateral sides of the knee. Indeed, cover plate 24 fully covers the front and sides of a user's knee through a full range of motion. In this aspect, the cover plate 24 includes an extended left side portion 24*a* and an extended right side portion 24*b* that wrap around the knee of the user and cover the sides of a user's knee.

The extended knee guard 8 is located over a gap between the knee guard 6 and the thigh guard 10 and includes a cushion pad 30 and a cover plate 32 that covers the cushion pad 30 and is affixed thereto. The thigh guard 10 also includes a cushion pad 34 and a cover plate 36 that covers the cushion pad 34 and is affixed thereto. The cushion pads 30,34 are formed similarly to the cushion pads 12,16,22 to provide the cushion/comfort and moisture wicking functions, and the cover plates 32,36 are formed similarly to cover plates 14, 18, 24 to provide the impact protection functions. Further, similarly to cover plate 18 of the shin guard 4, and cover plate 24 of the knee guard 6, cover plates 32,36 may include a plurality of air vents 20 that extend through the cover shells/plates 32,36 to allow for ventilation and expelling of sweat. The positioning and quantity of the air vents 20 are not limited to any particular configuration.

FIG. 1 shows the one exemplary embodiment for the configuration of the coupling of the knee guard 6, extended knee guard 8, and thigh guard 10. As shown in FIG. 1, the extended knee guard 8 overlays an upper portion of the knee guard 6 and a lower portion of the thigh guard 10 such that the extended knee guard 8 partially overlaps both the knee guard 6 and the thigh guard 10 and completely covers the space or gap defined between the knee guard 6 and the thigh guard 10. To hold the extended knee guard 8 in this position, the extended knee guard 8 may be attached to the knee guard 6, the thigh guard 10, or both the knee guard 6 and the thigh guard 10. In one embodiment, to ensure that the extended knee guard 8 remains in place, the extended knee guard 8 is attached to both the knee guard 6 and the thigh guard 10. The extended knee guard 8 may be attached to guards 6 and 10 using any suitable means known to those of ordinary skill in the art, such as a number of straps (not shown) extending through aligned openings (not shown) disposed in one or both of each of the knee guard 6 and the thigh guard 10, e.g., through the cover plate 24 and/or cushion pad 22 of the knee guard 6 and/or the cover plate 36 and/or cushion pad 34 of the thigh guard 10. In this configuration the extended knee guard 8 is held over the space between the knee guard 6 and the thigh guard 10, but in a manner that allows for some movement of the extended knee guard 8 to accommodate the movement of the user when wearing the leg guard 100.

Figure 2:
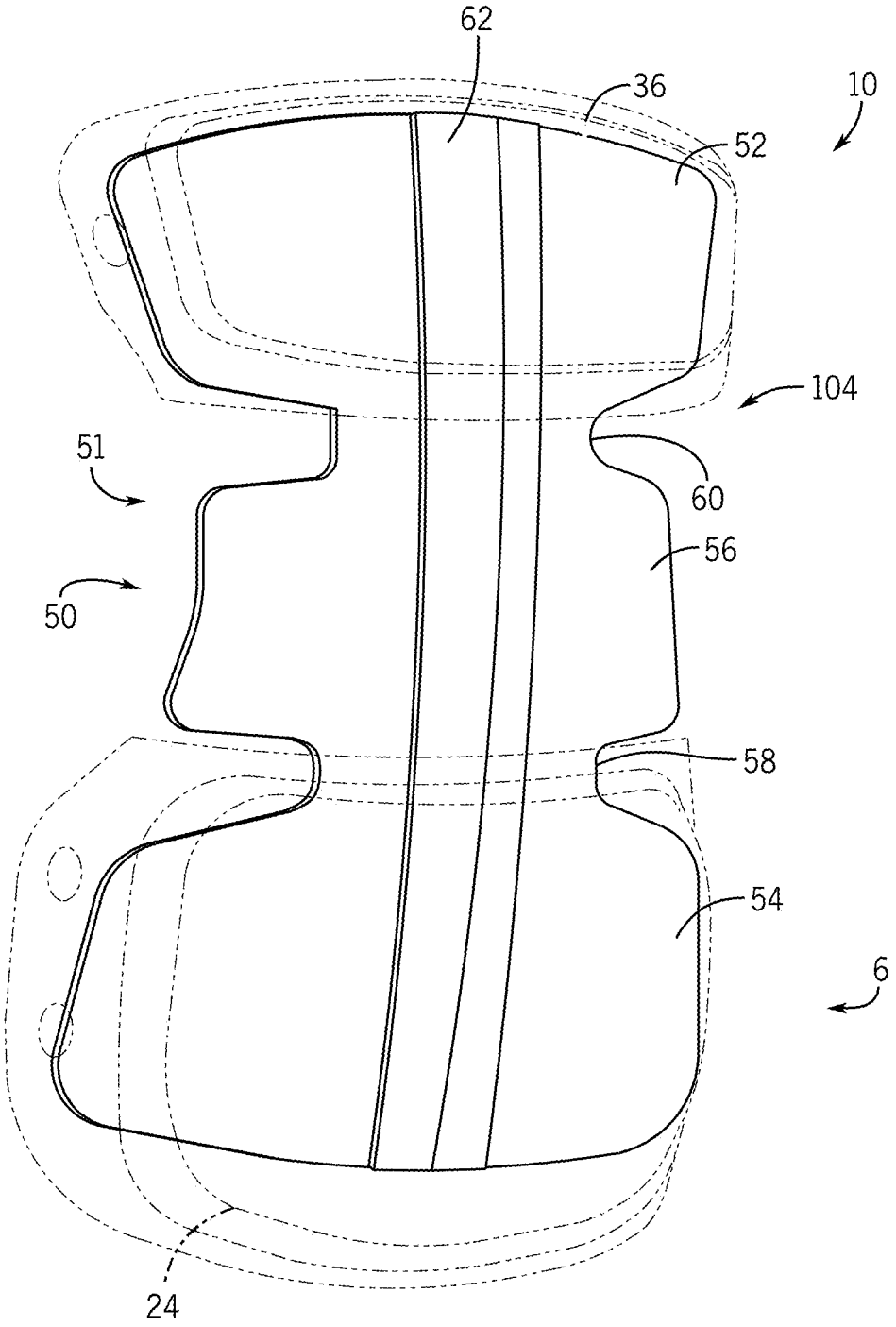
FIG. 2 is a partially broken away isometric view of a splint connector connecting a knee guard and a thigh guard of the leg guard of FIG. 1.
Figure 4:
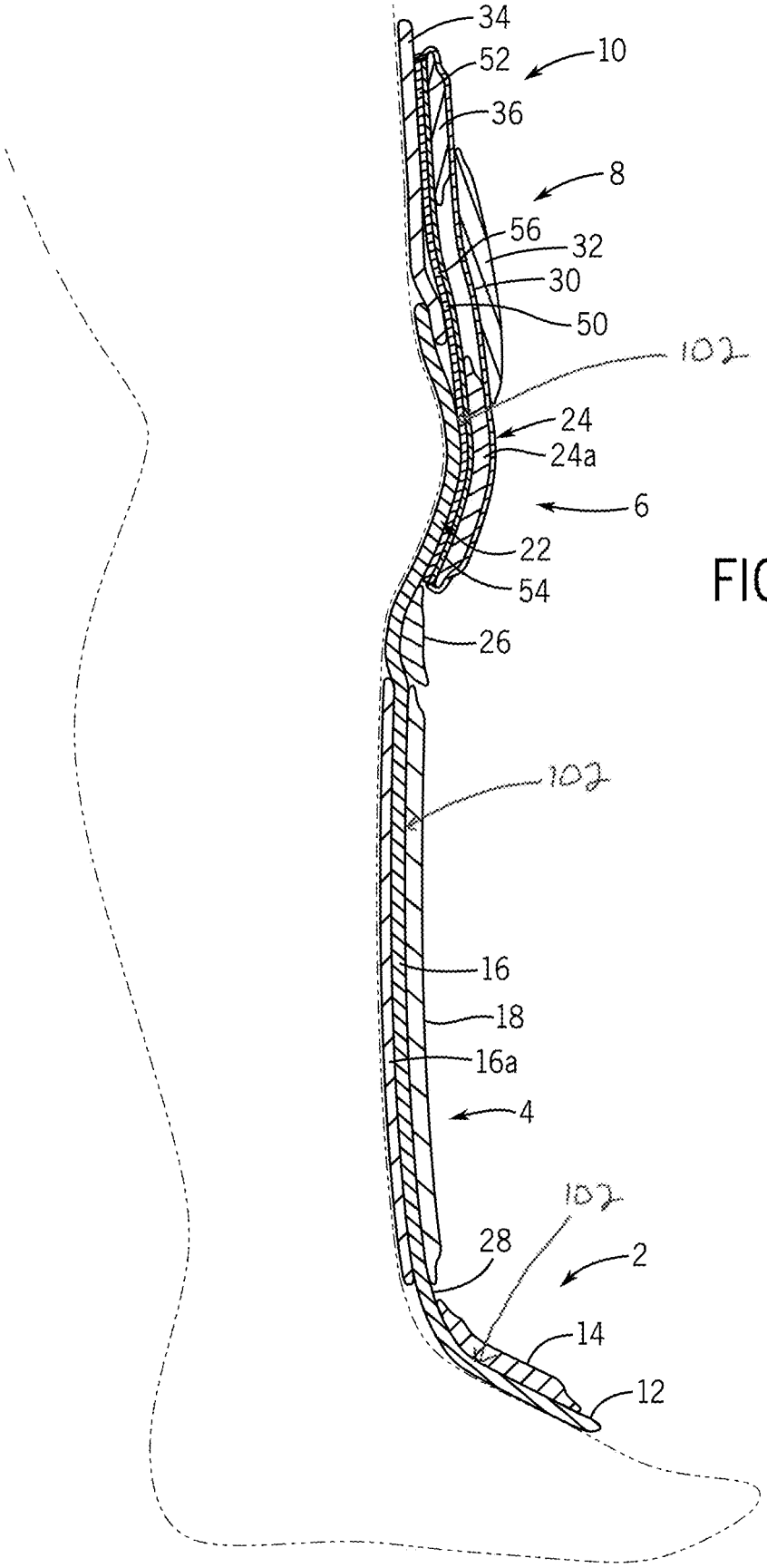
FIG. 4 is a cross-sectional view along line 4-4 of FIG. 2.

Looking now at FIGS. 1 and 2, an exemplary embodiment of the configuration of the coupling 104 of the knee guard 6, extended knee guard 8, and thigh guard 10 according to the present disclosure is illustrated with the coupling 104 in a standing position. As can best be seen in FIG. 2, with the extended knee guard 8 removed for clarity, the knee guard 6 is connected to the thigh guard 10 by the coupling 104. In the illustrated embodiment, the coupling 104 includes a splint connector 50 that connects the cover plate 24 of knee guard 6 to the cover plate 36 of thigh guard 10. The splint connector 50 can be secured to the knee guard 6 between the cover plate 24 and the cushion pad 22, such as by employing the manner of connection between the cover plate 24 and the cushion pad 22 to additionally secure the connector 50 between the cover plate 24 and the cushion pad 22 (FIG. 4). The connector 50 can also be secured to the thigh guard 10 in a similar manner between the cover plate 36 and the cushion pad 34 (FIG. 4). In this aspect, the splint 50 operatively attaches the thigh guard 10 to the knee guard 6. The splint connector 50 allows the knee guard 6/extended knee guard 8/thigh guard 10 configuration to bend or pivot such that each of the guards 6, 8, and 10 remains in place when the user assumes any one of a plurality of positions from squatting or crouching to/through an intermediate position to/through an upright position. The splint connector 50 also prevents the thigh guard 10 from sliding up and down the thigh when the user changes position.

As best shown in FIG. 2, in an exemplary embodiment for the construction of the connector 50, the splint connector 50 includes a body 51 having a first or upper portion 52 disposed in alignment with and connected to the thigh guard 10, e.g., between the cushion pad 34 and the cover plate 36, and a second or lower portion 54 disposed in alignment with and connected to the knee guard 6, e.g., between the cushion pad 22 and the cover plate 24. A central connecting portion 56 is positioned and extends between the upper portion 52 and the lower portion 54 to hold the upper portion 52 and lower portion 54 in position with regard to one another via narrowed strips 58,60 extending from each side of the central portion 56 to the adjacent upper portion 52 or lower portion 54. While the upper portion 52, lower portion 54, central portion 56, and strips 58,60 can be formed separately from one another, in the illustrated exemplary embodiment the portions 52-60 are each integrally with one another to form a single, monolithic splint connector 50.

The splint connector 50 is formed to be able to maintain its shape when placed under compression or tension forces, such that the splint connector 50 will not appreciably stretch or contract/compress when these forces are exerted on the splint connector 50, but that allows the splint connector 50 to hold tension like a rope, to hold compression like a support beam, to bend in one plane like a single hinge through the full range of the knee joint, and to twist slightly and to create and maintain a consistent separation distance between the knee plate and the thigh plate while the leg guard including the splint is being worn such that the splint 50 can bend and/or flex and/or twist, thereby accommodating the natural movements of the leg of the user wearing the leg guard 100 without restricting movement, including twisting or lateral movement of the thigh relative to the lower leg and/or knee, unlike the restrictive hinges utilized in prior art leg guards such that those in the '241 and '939 patents. This attribute of the splint connector 50 can be provided directly by the material selected to form the splint connector 50, and/or by a separate component of the construction for the splint connector 50 that is added to the connector 50. Suitable materials that the splint connector 50 can be formed of include various polymers including one or more thermoplastic polymers, such as acrylonitrile butadiene styrene (ABS), a flexible ABS, a high density polyethylene (HDPE) or a low-density polyethylene (LDPE), and combinations thereof, among others. This material enables the upper portion 52 and the lower portion 54 to be affixed to the adjacent thigh guard 10 and knee guard 6, respectively, using any suitable means through the flexibility of the material, while maintaining the structural integrity or compressibility of the material. The inclusion of the strips 58,60 between each of the upper portion 52 and lower portion 54 and the central portion 56 lessens the rigidity of the connector 50 at the locations of the strips 58,60, providing enhanced flexibility and twisting of the connector 50 at those points. As the locations of the strips 58,60 are generally aligned with the upper end of the knee guard 8 and the lower end of the thigh guard 10, the strips 58,60 allow for flexing and limited twisting of the knee guard 6 relative to the thigh guard 10.

In another exemplary embodiment the splint connector 50 can include one or more spines 62, as shown in FIG. 2. The spine 62 is disposed on or within the material forming the splint connector 50 and operates to provide an increased resistance to stretching and contraction of the splint connector 50. The spine 62 can be formed of any suitable material, such as materials similar to those used to form the splint connector 50, and can be secured to the body 51 in any suitable manner, such as be adhering, stitching, or rivets, among others, and in any suitable location, such as along a centerline of the body 51 extending between the upper portion 52 and the lower portion 54 on either of a front or rear surface of the body 51, or in one or more locations within the body 51.

Figure 3:
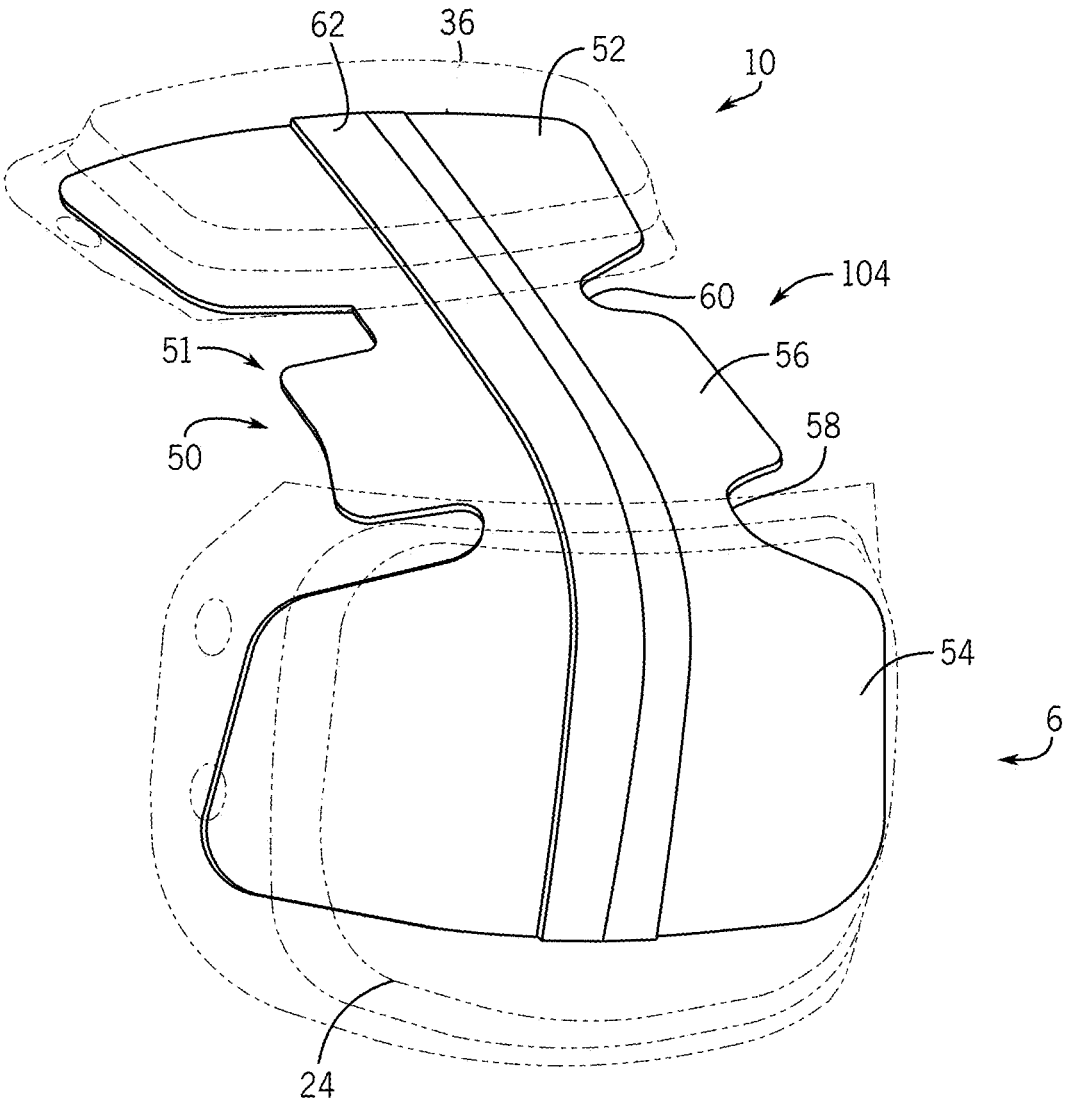
FIG. 3 is a partially broken away isometric view of the splint connector between the knee guard and thigh guard in a flexed position.

In any embodiment, the placement of the splint connector 50 extending between the knee guard 6 and the thigh guard 10, and beneath the extended knee guard 8, enables the splint connector 50 to flex and/or twist, to allow the knee guard 6 and thigh guard 10 to move with regard to one another when the wearer move between a standing position and a crouching position. However, the material forming the connector 50 also prevents compression of the connector 50, preventing the length of the splint connector 50 between the knee guard 6 and the thigh guard 10 to be altered as a result of the forces exerted on the splint connector 50. This function of the splint connector 50 maintains a consistent separation between the knee guard 6 and the thigh guard 10 throughout the movement of the leg guard 100 while enabling the wearer to freely move the knee joint through its full range of motion as well as to accommodate for limited twisting motion of the upper and/or lower portions of the leg relative to the knee joint. This is more clearly illustrated in FIG. 3 illustrating the position of the connector 50 in a 90 degree angle flexed position.

In alternative embodiments, the splint connector 50 can be positioned between other adjacent individual or multiple pairs of guards 2,4,6,8,10 forming the leg guard 100, and can be employed as the sole connector between one or more adjacent pairs of guards 2,4,6,8,10 forming the leg guard 100, or can extend the length of the leg guard 100 as a single connection between each adjacent pair of guards 2,4,6,8,10. Further, the splint connector 50 can be formed with a sufficient thickness and/or a cushion or padding layer (not shown) thereon to enable the splint connector 50 to function as and/or replace one or more cushion pads 12,16,22,26,30,34 of the leg guard 100.

The disclosures of all articles and references, including patents, are incorporated herein by reference. The invention and the manner and process of making and using it are now described in such full, clear, concise and exact terms as to enable any person skilled in the art to which it pertains, to make and use the same. All references cited in this specification are incorporated herein by reference. It is to be understood that the foregoing describes preferred embodiments of the present invention and that modifications may be made therein without departing from the spirit or scope of the present invention.

What is claimed is:

1. A leg guard comprising:

a) a first guard;

b) a second guard; and c) a connector secured between the first guard and the second guard, wherein the connector is formed of a material that is flexible but resistant to stretching and compression forces, wherein the connector includes a first portion secured to the first guard and a second portion secured to the second guard, wherein the first guard includes a first cover plate, wherein the first guard includes a first cushion pad secured to the first cover plate, and wherein the first portion is secured to the first cover plate between the first cushion pad and the first cover plate.

2. The leg guard of claim 1, wherein the connector is secured to the first guard and the second guard by a securing mechanism selected from the group consisting of stitching, rivets, adhesives, fasteners and combinations thereof.

3. The leg guard of claim 2, wherein the connector is formed as a monolithic structure.

4. The leg guard of claim 1, wherein the connector includes a central portion disposed between the first portion and the second portion.

5. The leg guard of claim 1, wherein the second guard includes a second cover plate, and wherein the second portion is secured to the second cover plate.

6. The leg guard of claim 5, wherein the second portion includes a cushion pad opposite the second cover plate.

7. The leg guard of claim 1, wherein the connector is formed of ABS, LDPE or combinations thereof.

8. The leg guard of claim 1, further comprising a spine disposed on the connector.

9. The leg guard of claim 8, wherein the spine is disposed on an exterior surface of the connector.

10. The leg guard of claim 8, wherein the spine is disposed within the interior of the connector.

11. A leg guard comprising:

a) a first guard;

b) a second guard; and c) a connector secured between the first guard and the second guard, wherein the connector is formed of a material that is flexible but resistant to stretching and compression forces, wherein the connector includes a first portion secured to the first guard and a second portion secured to the second guard, wherein the first guard includes a first cover plate, wherein the first guard includes a first cushion pad secured to the first cover plate, wherein the first portion is secured to the first cover plate between the first cushion pad and the first cover plate, wherein the second guard includes a second cover plate, wherein the second guard includes a second cushion pad secured to the second cover plate, and wherein the second portion is secured to the second cover plate between the second cushion pad and the second cover plate.

12. The leg guard of claim 11, further comprising an extended knee guard connected to one of the first guard or the second guard and positioned over the connector.

13. The leg guard of claim 11, wherein the connector is formed of a thermoplastic polymer.

* * * * *